US005974976A

United States Patent [19]

Gasparrini et al.

[11] Patent Number: 5,974,976

[45] Date of Patent: Nov. 2, 1999

[54] CLEANING SYSTEM AND PROCESS FOR MAKING SAME EMPLOYING REDUCED AIR CLEANING FABRIC

[75] Inventors: C. Robert Gasparrini, Port Chester, N.Y.; Walter H. Cano, Bridgeport, Conn.

[73] Assignee: Baldwin Graphic Systems, Inc., Stamford, Conn.

[21] Appl. No.: 08/924,495

[22] Filed: Aug. 27, 1997

Related U.S. Application Data

[63] Continuation of application No. 08/431,799, May 1, 1995, abandoned.

[51] Int. Cl.[6] ..... B41C 33/00

[52] U.S. Cl. ..... 101/483; 101/424

[58] Field of Search ..... 101/483, 424, 101/423, 425; 100/37, 47

[56] References Cited

U.S. PATENT DOCUMENTS

| | | | |
|---|---|---|---|
| 2,189,556 | 2/1940 | Younghusband | 206/209 |
| 3,014,579 | 12/1961 | Lathrop | 401/196 |
| 3,066,876 | 12/1962 | Verdier | 100/161 |
| 3,669,255 | 6/1972 | Raymus | 206/59 F |
| 3,850,294 | 11/1974 | Phillips et al. | 206/205 |
| 3,980,176 | 9/1976 | Boggs | 206/392 |
| 4,135,448 | 1/1979 | Moestue | 101/425 |
| 4,295,563 | 10/1981 | Becker et al. | 206/205 |
| 4,344,361 | 8/1982 | MacPhee et al. | 101/425 |
| 4,467,916 | 8/1984 | Hedden et al. | 206/410 |
| 4,678,724 | 7/1987 | Inagabi | 229/4.5 |
| 4,712,472 | 12/1987 | Meisen et al. | 100/37 |
| 4,757,763 | 7/1988 | MacPhee et al. | 101/425 |
| 4,934,391 | 6/1990 | Futch et al. | 134/40 |
| 4,986,182 | 1/1991 | Sawaguchi et al. | 101/483 |
| 4,998,984 | 3/1991 | McClendon | 206/205 |
| 5,009,716 | 4/1991 | Gerson | 134/40 |
| 5,012,739 | 5/1991 | Loos et al. | 101/425 |
| 5,104,567 | 4/1992 | Staehr | 252/174.17 |
| 5,125,342 | 6/1992 | Hara | 400/425 |
| 5,143,639 | 9/1992 | Krawack | 252/162 |
| 5,176,080 | 1/1993 | Gasparrini et al. | 101/425 |
| 5,188,754 | 2/1993 | Weltman et al. | 252/162 |
| 5,194,173 | 3/1993 | Folkard et al. | 252/170 |
| 5,207,160 | 5/1993 | Harada | 101/425 |
| 5,320,217 | 6/1994 | Lenarz | 206/209 |
| 5,368,157 | 11/1994 | Gasparrani et al. | 206/209 |
| 5,392,701 | 2/1995 | Schiel | 100/161 |

FOREIGN PATENT DOCUMENTS

| | | |
|---|---|---|
| 0256950 | 2/1988 | European Pat. Off. . |
| 0348609 | 1/1990 | European Pat. Off. . |
| 2004511 | 8/1971 | Germany . |
| 3907612 | 9/1990 | Germany . |
| 9511584 | 5/1995 | WIPO . |

OTHER PUBLICATIONS

European Search Report, Jan. 8, 1997.
English language translation of DE 3907612 A1.

*Primary Examiner*—Edgar Burr
*Assistant Examiner*—Anthony H. Nguyen
*Attorney, Agent, or Firm*—Morgan & Finnegan, L.L.P.

[57] ABSTRACT

A cleaning system for a printing press using pre-soaked, reduced volume of air in cleaning fabric and a method for making the system are disclosed. The system includes a cleaning fabric treated to reduce the amount of air volume the cleaning fabric contains. The cleaning fabric is saturated to functional equilibrium with a low volatility organic compound solvent. The cleaning fabric is wrapped around an elongated core to form a fabric roll. The saturated, wrapped fabric roll may be used to clean a cylinder of a printing press. The saturated, wrapped fabric roll may be inserted in a sealable sleeve, the sealable sleeve being in contact with the fabric roll and then sealed, thus permitting transporting and storage of the system until use without detrimentally affecting the cleaning ability of the fabric.

26 Claims, 2 Drawing Sheets

CLEANING SYSTEM AND PROCESS FOR MAKING SAME EMPLOYING REDUCED AIR CLEANING FABRIC

This is a continuation of application Ser. No. 08/431,799, filed on May 1, 1995, now abandoned.

FIELD OF THE INVENTION

This invention relates to a cleaning system employing a fabric with a reduced volume of air for use to clean the cylinders of a printing machine. More particularly, the invention relates to an improved pre-soaked cleaning system employing a fabric with a reduced volume of air to clean the cylinders of a printing press. While the invention is described as it applies to the cleaning of the cylinders of printing machines for the sake of simplicity, it is to be understood that it can be utilized to clean the cylinders of other types of machinery.

BACKGROUND OF THE INVENTION

A wide variety of blanket cleaning systems and apparatus employing the same to clean the cylinders of printing presses are known. Typical blanket cleaning systems and apparatus employing the same, including cleaning blankets and cleaning solutions, are exemplified by U.S. Pat. No. 4,135,448 to Moestue which is directed to a mechanism for cleaning a cylinder that is provided with a cleaning cloth which is wetted with a cleaning fluid or solution prior to its encountering the pressure roller; U.S. Pat. No. 4,934,391 to Futch et al. is directed to a composition for ink removal that exhibits a low vapor pressure and which is a low vapor pressure organic compound; U.S. Pat. No. 4,986,182 to Sawaguchi et al. is directed to a cleaning apparatus in which a cleaning cloth is dampened by a liquid; U.S. Pat. No. 5,009,716 to Gerson is directed to a wash for removing ink comprising a low volatile organic compound; U.S. Pat. No. 5,012,739 to Loos is directed to a washing device comprising a cleaning cloth dampened with a washing medium and U.S. Pat. No. 5,069,128 to Hara is directed to a device for cleaning a cylinder of a printing machine comprising a cleaning cloth impregnated with a cleaning liquid.

In addition, U.S. Pat. No. 5,104,567 to Staehr is directed to a liquid for cleaning ink from printing machines; U.S. Pat. No. 5,125,342 to Hara is directed to a method for cleaning the cylinder of a printing machine; and U.S. Pat. No. 5,143,639 to Krawack is directed to a cloth moistened with a low vapor pressure cleaning agent for removing ink; whereas U.S. Pat. No. 5,188,754 to Weltman et al. is directed to a cloth soaked with a cleaning formula and U.S. Pat. No. 5,194,173 to Folkard et al. is directed to a method for removing ink from printing machines. Still further, U.S. Pat. Nos. 4,344,361 and 4,757,763 to MacPhee et al. is directed to automatic blanket cylinder cleaners provided with cleaning fabrics adapted to contact the blanket cylinders of printing presses. On the other hand, U.S. Pat. No. 5,175,080 to Gasparrini et al. is directed to a cloth supply system for the blanket cylinder for use in printing presses.

Still further, U.S. Pat. No. 5,320,217 to Lenarz is directed to a sealed envelope which contains a moistened pad that functions as a swab. The pad is secured to the envelope by an intermediate line seal. Consequently, when the top of the envelope is removed, the pad is exposed. Since the pad is still captively held to the remainder of the envelope, the liquid on the pad may be dispensed by holding the clean, dry, bottom of the envelope. Thus, the pad functions as a swab and the remainder of the envelope functions as the applicator and the reservoir. Alternatively, U.S. Pat. No. 4,998,984 to McClendon is directed to a pre-packaged single use disposable wiper pad or towelette that is saturated with a disinfecting liquid and the pad is effective to disinfect inanimate surfaces. The pad is of a size which fits into a pocket or purse and makes it convenient to carry, while posing no problem in disposing of the same, such as by flushing in a toilet.

U.S. Pat. No. 4,679,724 to Inagaki is directed to a water-proof container having a cylindrical base member made of paper which is surrounded by a double-wall heat-shrinkable plastic film covering the paper base member and having at least one portion heat-sealed to close the paper base member entirely within the plastic film and lid connected to the base member for closing at least one open end of a container shape formed by the paper base member.

U.S. Pat. No. 4,467,916 to Hedden et al. is directed to a package of wound glass fiber strand from which the glass fiber strands can be removed more efficiently for feeding into processing operations. The wound package of glass fiber strands is a package of superimposed annular layers of glass fiber strands having a central longitudinal, cylindrical cavity about which the strands are wound and having an outer cylindrical surface and a substantially flat circular top and bottom section. The package is covered with a stretchable polymeric film and at least one free end of the glass fiber strand extends into the central cavity for removal from the interior to the exterior of the package. U.S. Pat. No. 4,295,563 to Becker et al. is directed to an article of manufacture comprising a hollow rod of longitudinally gathered tubes of cellulose hydrate-based materials the hollow rod having a latent water content of between about 25% and 100% by weight based on the total weight of the hollow rod and being free of chemical anti-bacteriocidal agent; a closed, substantially gas impermeable packaging sheath having a hollow interior chamber therein and in which the hollow rod is positioned so that this rod is completely enveloped by the packaging sheath which is made of a flexible film of material that is substantially impermeable to gases; and a protective gas essentially fills the remaining portion of the hollow interior chamber of the sheath so that the gas protects the hollow rod against the formulation of aerobic microorganisms on the water-containing cellulose hydrate material.

Still further, U.S. Pat. No. 3,980,176 to Boggs is directed to a high speed yarn take-up system which consists of a pneumatic injector nozzle rotably mounted off-center of a single fluted rotating screw. Yarn is injected into the area exposed at the trailing edge of the screw and compressed and moved forward in a compression chamber by the feeding of the screw. A plastic tube is continuously formed around the compression chamber to receive the yarn mass as it discharges, thus forming a tube of indefinite unlimited length and from ¼ to 4 inches or larger in diameter. The tube may contain a single end or multiple ends of yarn which may be removed from the tube at high speed by simply slitting the plastic as the yarn is pulled from the package. Alternatively, U.S. Pat. No. 3,850,294 to Phillips et al. is directed to a package of roving unsized continuous filaments of glass, the package being saturated with water which maintains the filaments in group orientation.

U.S. Pat. No. 3,014,579 to Lathorp is directed to a disposable cleaning device which consists of a capsule containing a plurality of applicators and which may be employed in many and various uses. The applicators enclosed within the capsule comprise a central core of sponge or sponge rubber having a wad or pad of absorbent material, such as cotton or the like, wrapped around the core.

The core is saturated with suitable material and the cotton wrap, for example, provides a vehicle through which the material in the sponge rubber core is absorbed from the core and applied to a given usage.

Still further, U.S. Pat. No. 2,189,556 to Younghusband is directed to a pipe cleaner formed with a pliable metal member, such as a spindle or length of wire or the like. Attached to that member and extending through at its length are tufts of fabric or other material capable of absorbing liquid. These tufts are impregnated or saturated with a liquid solvent solution and the impregnating pipe cleaners are then packed in a container and sealed to prevent evaporation.

While the above-mentioned patents accomplish their purposes to a satisfactory extent, they still exhibit a variety of drawbacks. For example, they usually require apparatus, such as pumps, spray bars, manifold lines, valves, and the like as part of the automatic blanket cleaning systems for introducing the cleaning solvents or solutions to the cleaning fabric just prior to actual use. Moreover, even in these cases, where the cleaning rolls or fabric rolls are pre-soaked or pre-wetted, the pre-soaking or pre-wetting, must be accomplished just before use in order to minimize loss of cleaning solvent or solution in order to provide an effective cylinder cleaning system.

U.S. Pat. No. 5,368,157 to Gasparrini et al., the present applicants, attempted to overcome these problems. That patent is directed to a pre-packaged, pre-soaked cleaning system for use with printing machines or the like to clean the cylinders of such machines and which comprises a pre-soaked fabric roll saturated to functional equilibrium with low volatility organic compound solvent and which is disposed around an elongated, cylindrical core and enclosed in a sealed sleeve which if desired may be a heat-sealed or a heat-shrunken and heat-sealed plastic sleeve disposed around and intimate contact with the fabric roll, whereby the pre-soaked saturated fabric roll can be transported and stored vertically and/or horizontally until use without substantially disturbing the distribution of the solvent in the fabric roll and detrimentally effecting the cleaning ability of the fabric.

While the invention disclosed in U.S. Pat. No. 5,368,157 works for its intended purpose, improvements have been discovered. When the patented product is placed in the vertical position, the solvent would shift downward in the evacuated package. When the package is restored to the horizontal position, the solvent migrates back towards equilibrium in the roll. This migration is caused by air pockets in the fabric of the roll that have not been completely evacuated.

There exists, therefore, a need for providing a prepackaged, pre-soaked blanket cleaning system which minimizes the above-mentioned disadvantages and drawbacks. The present invention fulfills such a need.

SUMMARY OF THE INVENTION

Briefly described, the present invention is directed to a new and improved system for cleaning a cylinder of a printing press using a pre-soaked fabric having a reduced volume of air which prevents and/or reduces the migration of the solvent in the fabric roll and increases the length of the cleaning fabric without increasing the diameter of the fabric roll. In accordance with a preferred embodiment, the cleaning system includes a core. Preferably, but not necessarily, the core is hollow and cylindrically shaped. A cleaning fabric with a reduced air content is wrapped around the core to form a fabric roll. A wetting agent comprising a low volatility cleaning compound is present in the cleaning fabric in an amount sufficient to saturate the cleaning fabric to functional equilibrium.

Advantageously, the fabric roll is sealed by a sleeve disposed around the cleaning fabric. The sleeve may also be in intimate contact with the fabric roll. This allows the cleaning fabric to be transported and stored both vertically and horizontally until use without substantially disturbing the distribution of the solution in the fabric and detrimentally affecting the cleaning ability of the fabric.

In a preferred embodiment, the air content of the cleaning fabric is reduced by between about 1% to about 50%. This acts to reduce the thickness of the fabric. It also acts to increase the length of fabric while not increasing the diameter of the fabric roll.

Another preferred embodiment further includes a means for positioning the fabric adjacent to a cylinder to be cleaned. This means may also place the cleaning fabric operatively associated with the cylinder or in a position to clean the cylinder while the fabric is in contact with and fed past the cylinder.

The invention also includes a method for making the inventive cleaning system. Broadly, the method comprises reducing the air in a strip of cleaning fabric. The strip of cleaning fabric is placed in contact with a low volatility organic compound solvent which does not evaporate readily at ambient temperature and pressure and saturating the cleaning fabric with the solvent. Solvent is applied by measured absorption to the fabric to obtain a fabric saturated to functional equilibrium with the solvent. The saturated cleaning fabric is wrapped around a core to form a pre-soaked fabric roll.

In a more specific aspect of the method, the fabric roll is sealed to allow transportation and storage, both vertically and horizontally, until use without substantially disturbing the distribution of the solvent in the fabric roll and detrimentally affecting the cleaning ability of the fabric roll.

In still another aspect of the method, the content of air in the cleaning fabric is reduced by calendaring.

In yet another more specific aspect of the method, the content of air in the cleaning fabric is reduced by reducing the thickness of the cleaning fabric by between about 10% to about 50%.

In yet another more specific aspect of the method, the amount of air in the cleaning fabric is reduced by between about 1% and about 50%.

It will be appreciated by those skilled in the art that the foregoing summary of the invention and the following detailed description are merely exemplary and explanatory of the present invention, but are not intended to be restrictive thereof or limiting of the advantages which can be achieved by the invention or various combinations thereof. The accompanying drawings referred to herein and constituting in part hereof, illustrate preferred embodiments of the invention and, together with the detailed description, serve to explain the principles of the invention.

BRIEF DESCRIPTION OF THE DRAWINGS

In order to understand the invention more fully, reference is directed to the accompanying drawings, which is to be taken in conjunction with the following description of the invention and in which Drawings.

DESCRIPTION OF THE PREFERRED EMBODIMENTS

Figure 1:
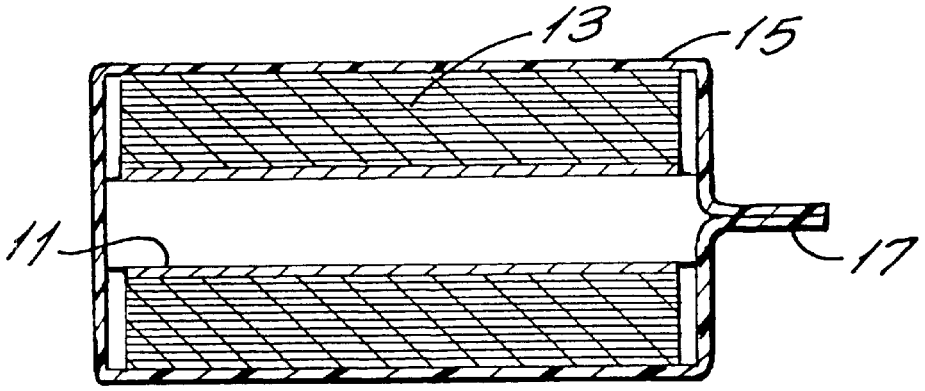
FIG. 1 is a lateral, sectional, elevational view of a cleaning system employing a reduced volume of air in cleaning fabric according to the invention.
Figure 2:
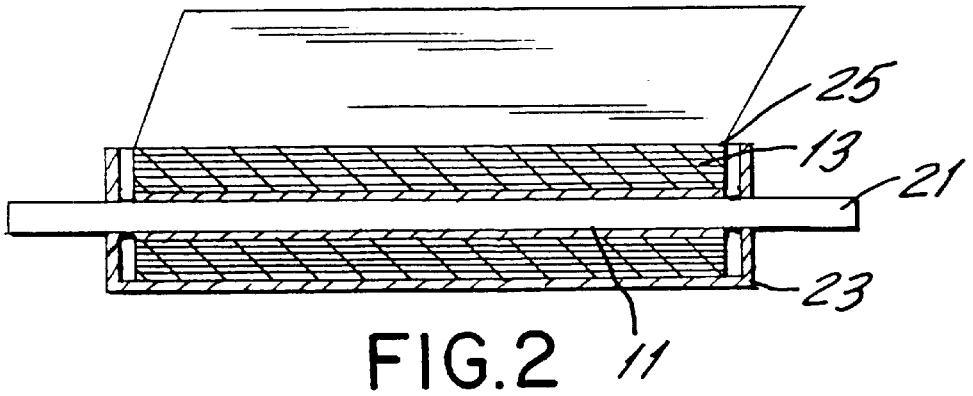
FIG. 2 is a lateral, sectional, elevational view of the system shown in FIG. 1, including the disposition of the presoaked, wrapped roll in a slotted canister before it is inserted in the sealable sleeve and/or sealable and shrinkable sleeve shown in FIG. 1.

Referring now to FIG. 1, a cleaning system employing a reduced volume of air in cleaning fabric with a longer length but not an increased diameter according to the present invention comprises an elongated core 11 made from, for example, relatively heavy cardboard of sufficient strength so that it can support thereon a pre-soaked fabric roll 13. Additionally, if desired, the core 11 can be made from any other suitable material including, but not limited to, plastic or metal, such as steel, aluminum, and the like. Core 11 may have open ends to allow engagement on an appropriate machine. Core 11 may also be a shaft. Preferably, as shown in FIG. 2, core 11 is completely hollow to allow a shaft, rod, or the like 21 to be inserted within core 11 to provide engagement. The core 11 is also preferably provided with engagement means (not shown), for reception of a shaft 21 located on an appropriate machine (not shown), such as a printing machine or the like, provided with a take-up shaft 52 to take-up the cleaning fabric after it has achieved its cleaning function. Alternatively, shaft 21 may be equipped with engagement means (not shown) for engagement of a core 11. Preferably, the core 11 is cylindrical in shape. However, the core 11 may be any other appropriate shape.

Figure 5:
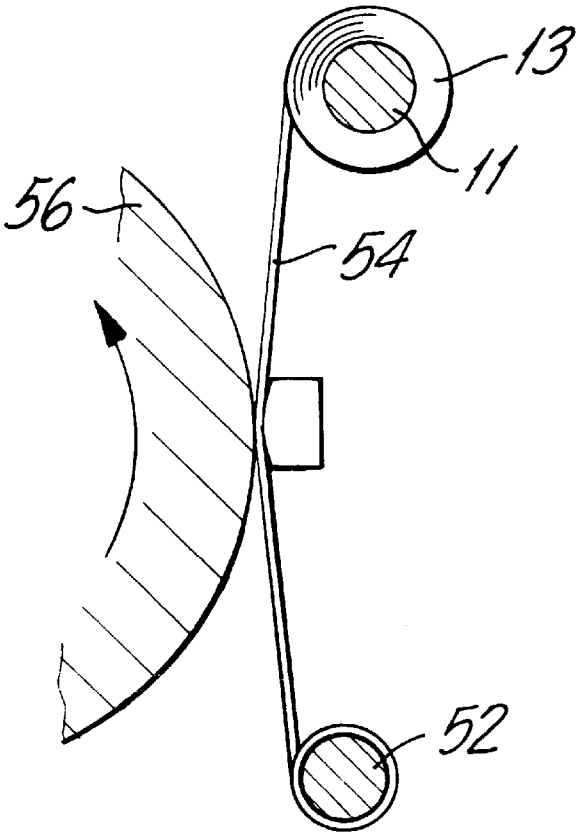
FIG. 5 is a partial cross-sectional view of a cylinder to be cleaned and a pre-soaked cleaning system employing a reduced volume of air in fabric according to the present invention.

The machine further includes a means for properly positioning the cleaning fabric to allow cleaning of the cylinder. Several ways exist for this result to be achieved. For example, the cleaning fabric 54 may be positioned so that it is adjacent the cylinder 56 to be cleaned. In another example, the cleaning fabric 54 may be adjacent to and operatively associated with the cylinder 56 to be cleaned. In yet another possible embodiment, the cleaning fabric 54 is operatively associated with the cylinder 56 to clean the cylinder 56 as the fabric 54 is in contact with and fed past the cylinder 56. One possible arrangement is shown in FIG. 5. The person of ordinary skill in the art will be aware of many other configurations that will work for the invention's intended purpose without undue experimentation. These examples are merely exemplary and are not meant to limit how the invention may be used.

The fabric is presoaked and saturated with a low volatility organic compound solvent, as described in more detail hereinbelow, before or after it is wrapped around the core 11 to form roll 13 in any convenient matter. Solvent is applied in measured amounts so that the fabric is presoaked to functional equilibrium. The preferred method of applying solvent is measured absorption of solvent. If desired, an excess amount of solvent can be applied and the excess solvent drained or spun off to obtain functional equilibrium rather than the use of measured absorption. In a preferred embodiment, the roll 13 is then inserted into a sealable sleeve 15 which is to be sealed in any convenient and appropriate matter. Preferably, sleeve 15 is made of heat-sealable or heat-sealable and shrinkable plastic material which is heat sealed along its edge 17 or shrunken and heat-sealed along its edge 17. The sealing of sealable sleeve 15 preferably places sleeve 15 in intimate contact with fabric roll 13.

In the modified embodiment of the invention illustrated in FIG. 2, the pre-soaked fabric roll is inserted in a sleeve or canister 23, provided with a slit 24 through which a portion of the fabric roll 13 can be withdrawn before the assembly is sealed in the sleeve.

Figure 3:
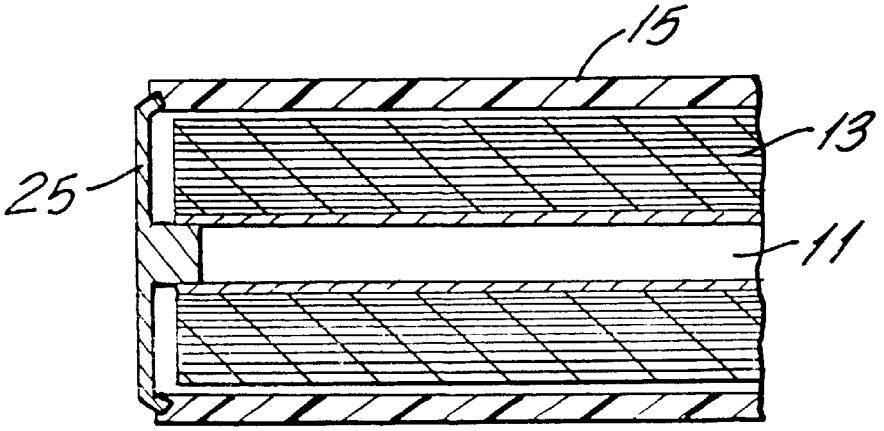
FIG. 3 is a partial, sectional, elevational, diagrammatic view of the system shown in FIG. 1 employing end caps disposed in the open ends of the elongated core and extending over the peripheral edges of the fabric roll.

In yet another modified embodiment, as shown in FIG. 3, the system of this invention is also preferably provided with end caps, such as end cap 25, made of plastic or metal or like material disposed in the open ends of the core 11. The end caps extend over the peripheral edges of the fabric roll 13 and the sleeve 15 may extend, as shown, over the edges of the end caps or it may extend completely around the ends of the roll 13 as shown in FIG. 1. Obviously, when a slotted canister 23 is employed end caps will not be used. Moreover, it is to be understood that it is within the purview of this invention that the sleeve is sized conveniently to accommodate the roll to be covered thereby and to be drawn or shrunken into intimate contact with the roll and sealed, as needed, whether it be open at both ends or at one end only.

The fabric from which the fabric roll is made may vary widely. For example, it may be made of paper, cloth, film, a mixture of wood pulp and polyester, such as DuPont SONTARA, or any other suitable material. In those cases where a cloth fabric is employed, it may be a woven or non-woven cloth fabric made of synthetic or natural fibers or mixtures of the same. Exemplative, but not limitative, of suitable synthetic fibers which may be used in the cloth fabrics are polyester fibers, rayon fibers, nylon fibers, and acrylic fibers and the like. Exemplative, but not limitative, of the natural fibers which may be employed are cotton fibers, wood pulp fiber, hemp fibers and the like.

In those cases where paper is employed as the fabric material, paper fabrics made from wood pulp modified chemically in accordance with paper manufacturing technology are suitable.

On the other hand, no matter what fabric is employed in carrying out the practice of this invention, it is preferred that the materials used therein exhibit high acceptability to being soaked or wetted by a solvent. Preferably, this solvent is a low volatility organic compound solvent used to saturate the fabric. In this regard, it is preferred that the fabric employed be one which has a caliper thickness in a range from about 0.003 inches to about 0.030 inches, and preferably in a range from about 0.007 inches to about 0.020 inches, and the ability, when saturated with low volatility organic compound solvent, to retain from about 0.02 cc to about 0.5 cc of solvent per $in^2$ of fabric determined by routine testing methods.

In general, woven and non-woven fabrics suitable for use in carrying out the practice of the invention have a basic weight in a range of from about 1.5 ounces per square yard to about 6.0 ounces per square yard, a caliper thickness in the range mentioned above, a tensile strength in the longitudinal (machine) direction in a range of from about 20 lbs. per inch to about 200 lbs. per inch and in a width (cross) direction in a range from about 15 lbs. per inch to about 125 lbs. per inch.

When paper is employed as a cleaning fabric in the system of this invention, it preferably has a basis weight in a range of from about 40 lbs. to about 90 lbs., a caliper thickness in a range of from about 0.003 inches to about 0.010 inches, a tensile strength in the longitudinal (machine) direction in a range of from about 20 lbs. per inch to about 80 lbs. per inch and in the width (cross) direction in a range of from about 15 lbs. per inch to about 50 lbs. per inch, a porosity in a range of from about 1.0 second to about 10 seconds when subjected to 100 cc of low volatility organic compound solvent or water, and a stretch ability in a range of from about 1.0 percent to about 6.0 percent all determined by routine testing methods.

Regardless of the type of material used as the cleaning fabric, the fabric must have a reduced air content. In one embodiment, all of the air is removed from the fabric. In another embodiment, between about 1% and about 50% of the air is removed. One method of accomplishing this reduced air content is to start with a fabric with substantially no or little air content. Alternatively, if the fabric initially has a substantial air content, this air content can be removed from the fabric to produce a reduced air content fabric. The reduced air content provides for an absorptive solvent amount and a reduced displacement of solvent during storage and thus less of a shift or no shift in the fabric roll's center of gravity and allows for better and more even distribution of the solvent within the fabric roll 13.

Figure 4:
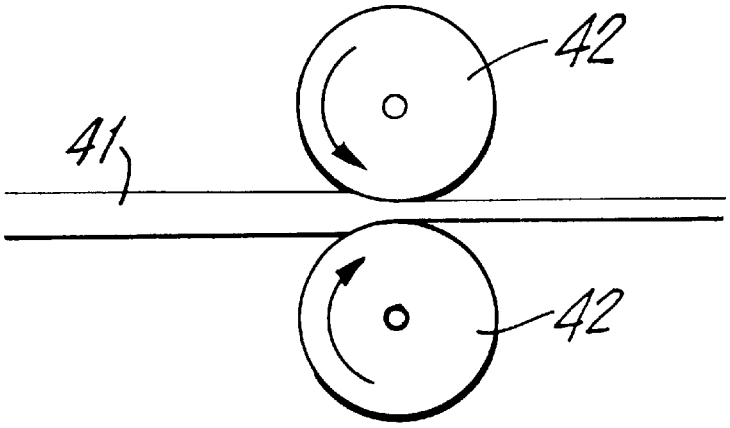
FIG. 4 is a sectional view of a fabric undergoing calendaring.

The preferred, but not exclusive, method of reducing the air content in the fabric is calendaring. Calendaring is demonstrated in FIG. 4. A fabric 41 is calenderized by running it through at least a pair of rollers 42. The at least a pair of rollers 42 compress the fabric. Preferably, but not necessarily, the temperature of the at least a pair of rollers 42 is hotter than room temperature. Alternatively, the temperature of the at least a pair of rollers 42 is at about ambient temperature or less than ambient temperature. It has been found that the wettability and the distribution of the solvent is very good in the calenderized fabric.

The amount of calendaring necessary to remove the air from the fabric is dependent on the fabric. For example, if standard cloth of 0.012 inches is used, such as DuPont's SONTARA, it is preferred that the fabric is calendared to reduce its thickness to about 0.0085 inches. This reduces the air content in the cloth by about 30%.

A surprising and unexpected result of the calendaring process is that the length of fabric is increased while not increasing the diameter of the fabric roll 13. This provides an important advantage because cleaners are designed to accept fabric rolls of up to a certain diameter. For example, one of the assignor's automatic blanket cleaners will only accept a cleaning fabric roll having a diameter of about 2.75 inches. Because of this extra length, a fabric roll of calenderized cloth will be usable for more washes than a regular fabric roll of the same fabric having the same diameter. This has two advantages. First, the cost per wash will be reduced. Second, the pressmen need not change a roll of cleaning fabric as often since there are more washes per roll of cloth. This will allow for the press to be run more often. These advantages can be realized regardless of whether the fabric is pre-soaked and/or prepackaged.

The amount of increase in the length of cloth due to calendaring is dependent on the fabric used and the amount of calendaring. For example when DuPont SONTARA cloth having a thickness of about 0.012 inches and a length of about 12 yards is placed about a core, having a diameter of about 1.5 inches, the fabric roll has a diameter of 2.75 inches. After being calendared the cloth has a thickness of about 0.0085 inches and a length of about 16 yards and still has a diameter of about 2.75 inches when placed on the same core. Thus, in this situation, calendaring results in an about 25% to about 30% increase in the length of the fabric without increasing the diameter of fabric roll 13. Depending on the type of fabric and amount of calendaring, results may range from about a 10% increase to about a 50% increase.

The low volatility organic compound solvent employed in carrying out the practice of this invention may vary widely and generally it includes at least one low volatility, organic compound solvent which does not readily evaporate at ambient temperature and pressure, as well as mixtures of the same with similar low volatile organic compound solvents or with normally volatile organic compound solvents. Exemplative, but not limitative, of suitable solvent materials of this type are organic compound solvents selected from vegetable oils and citrus oils and the like. Generally, such solvent materials have a volatile organic content in a range of from about zero up to about 30.0 percent, and preferably a volatile organic content in a range of from about zero percent to about 20.0 percent, determined by routine testing methods. It is to be understood that within the purview of this invention, such suitable solvents also include normally volatile organic compound solvents, that is, those which readily evaporate and which are selected from mineral spirits and aliphatic hydrocarbon solvents and the like. Such solvent materials generally have a volatile organic content of from zero up to about 100 percent determined by routine testing methods. Preferably, a low volatility solvent will be used because the lower the volatility of the solvent, the longer the fabric stays wet since less solvent evaporates. The closer the volatility is to zero percent, the longer the life of the presoaked fabric on the printing press.

For the embodiments involving heat-sealing and/or heat-sealing and shrinking, a wide variety of heat-sealable and/or shrinkable and heat-sealable plastic materials may be used for sealable sleeve 15. For example, the sleeve may be made from polyethylenes, polyolefins, polyvinyl chlorides, and polyamides and the like. Generally, such materials are heat-sealable and/or shrinkable and heat-sealable at a temperature in a range of from about 300° F. to about 400° F., and preferably in a range of from about 350° F. to about 375° F. Moreover, it is to be understood that within the purview of this invention, the heat-sealable and/or shrinkable and heat-sealable sleeve may be made from heat-sealable and/or shrinkable and heat-sealable paper.

The method of making a cleaning system employing a reduced air content cleaning fabric according to the invention comprises obtaining a strip of reduced air content cleaning fabric. For purposes of this invention, the term reduced air content cleaning fabric additionally encompasses a fabric having no or substantially no air content. One method of obtaining a reduced air content cleaning fabric is to make or purchase a cleaning fabric with substantially little or no air content. Alternatively, a strip of fabric with a substantial air content can have its air content reduced. Preferably, the method of reducing the air content of the fabric is calendaring. The strip of reduced air content cleaning fabric is brought in contact with a low volatility, organic compound solvent which does not evaporate readily at ambient pressure and temperature and presoaking and saturating the cleaning fabric to functional equilibrium. This is preferably done by measured absorption. Excess solvent, if any, may be removed from the cleaning fabric, preferably by draining or spinning the excess solvent, to obtain a fabric saturated to functional equilibrium with the solvent. The cleaning fabric is wrapped around an elongated core forming a fabric roll.

In one variation of the method, the fabric is preferably wrapped around the core prior to contacting the same with the solvent. In yet another embodiment, the fabric is wrapped around the core after being saturated with the cleaning solvent. It is also within the invention to saturate the fabric with solvent both prior to and after forming the fabric roll 13. The wrapping of the fabric can be done in any convenient manner and requires no special apparatus, a wide variety of roll making equipment being readily available for accomplishing the same.

In a preferred embodiment, the method further comprises the step of sealing the fabric roll so that it can be transported and stored vertically and horizontally until use without substantially disturbing the distribution of said solvent in said fabric roll and detrimentally affecting the cleaning ability of the fabric. The preferred, but not exclusive, method of sealing the fabric roll is the use of a sealable sleeve disposed around the fabric roll. The preferred type of sealable sleeve is a heat-sealable plastic sleeve around the wrapped fabric roll and placed in intimate contact with the fabric roll and subjecting the sleeve to a temperature sufficient to seal the plastic sleeve around the wrapped fabric roll. In order to use this type of sealant, the fabric roll is inserted in a heat-sealable and/or shrinkable and heat-sealable plastic sleeve and the sleeve is heat-sealed and/or heat-sealed and shrunken at any appropriate temperature around the roll in intimate contact therewith. Generally, temperatures in a range of from about 300° F. to about 400° F., and preferably in a range from about 350° F. to about 375° F., are used to accomplish the heat-sealing and/or heat-sealing and heat-shrinking of the saturated fabric roll in the plastic sleeve and bringing the sleeve into intimate contact with the fabric roll.

In a variation of the method, it is preferred, especially where a heat-sealable plastic sleeve is employed, that once the fabric roll is inserted in the sleeve, the so assembled sleeve and fabric roll be subjected to a vacuum which draws the heat-sealable plastic sleeve into intimate contact with the fabric roll, while at the same time exhausting any air from the interior of the sleeve, and then simply heat-sealing the sleeve around the roll by application of heat to the open peripheral edges of the sleeve. Known appropriate vacuum apparatus and heat-sealing apparatus may be used by simple adaption of the same physically to accomplish apparatus for applying the vacuum and heat-sealing of the sleeve.

On the other hand, when a sleeve employed in carrying out the method is both heat-sealable and shrinkable, then one or more small openings or vent holes (not shown) in the sleeve, preferably located near the open edges of the sleeve, are provided to permit exhaustion of air from the sleeve as heat-sealing and shrinking is accomplished, the location of such opening or openings assuring that any such opening or openings will be closed during the heat-sealing and heat-shrinking of the sleeve.

In accordance with the method of this invention, contact between the fabric strip and the solvent can be achieved in a variety of ways by a variety of means for introducing the solvent including spray nozzles, pouring containers, and immersing tanks. For example, if desirable, the appropriate solvent may be poured over the fabric in amounts sufficient to saturate the same while simply permitting excess solvent to drain off into a tray, or the solvent can be sprayed on the fabric. The saturation step can be carried out at ambient temperature and pressure and the excess, as mentioned above, simply permitted to drain off for a period of time sufficient to obtain a fabric saturated to functional equilibrium. Any other appropriate method of removing the excess solvent to obtain a fabric saturated to functional equilibrium can be used.

It is within the purview of an embodiment of the invention that the fabric strip be immersed or transported through a tank of appropriate solvent in a substantially horizontal direction either before or after, and preferably before, it has been wrapped on the core to form a roll. After saturation has taken place, the saturated fabric is preferably simply suspended in a position to permit excess solvent to drain off or run through two rollers and be collected in a tray for reuse.

Additionally, in accordance with a preferred embodiment of the method, the air content of the fabric must be reduced or eliminated. Any appropriate reduction of air content step may be employed. The preferred method of reducing the air content of the fabric is calendaring. A fabric is calenderized by running it through at least a pair of rollers. The at least a pair of rollers compresses the fabric. Preferably, but not necessarily, the temperature of the pair of rollers is either hotter than room temperature or at or cooler than room temperature. A surprising and unexpected result of the removal of the air content is that the length of fabric is increased while not increasing the diameter of the fabric roll.

The wrapping of the fabric on the elongated core to form a roll, as well as measured absorption and/or draining or other removal thereof, may also take place at ambient temperature and pressure. When the saturation of the fabric and wrapping of the fabric to form a fabric roll are completed, the fabric roll may be inserted in a sleeve. Preferably, the fabric roll is inserted in a heat-sealable and shrinkable plastic sleeve and the sleeve is heat-sealed and/or shrunk and heat-sealed at a temperature sufficient to heat-seal the sleeve around and in contact with the saturated, wrapped fabric roll. In this regard, the particular shrinking and heating-sealing temperature will be dependent upon the type of shrinkable and heat-sealable material utilized. Care must be taken, however, to be sure that the particular temperature employed is not so high that it will have a deleterious affect on the saturated fabric roll disposed in the plastic sleeve.

In general, heat-sealing can be achieved at temperatures in a range of from about 300° F. up to about 400° F., and preferably are achieved at temperatures in a range of from about 350° F. up to about 375° F. and may be carried out in an oven, or under heat-radiating lamps.

The sleeve will be sized so that the wrapped fabric roll can be inserted therein with facility and the open edges of the sleeve then brought together in contact with each other in order to seal the same, while at the same time, being sized also so that if and when shrinking takes place, it will be brought into contact with the fabric roll around which it is disposed.

In those cases where the saturated, wrapped fabric roll is to be employed with a slotted canister 23, the roll is simply inserted in the canister 23 with a portion thereof protruding through the slot and the canister 23 is provided with a knock-out end portions which may be inserted therein after insertion of the roll, such end portions simply being removed when the roll is to be disposed on an appropriate shaft of a printing apparatus or the like in order to permit insertion of the shaft from the core. Moreover, the canister 23 may be made from metals, such as light gauge steel, aluminum and the like, or from cardboard or from plastic materials, such as polyethylenes, polyolefins, polyvinyl chlorides, polyamides, and the like.

In those instances where end caps, such as end caps 25, are employed in making the cleaning system employing a reduced air cleaning fabric, the end caps, which may be made of the same materials mentioned above for the canister 23, are simply inserted in the open ends of the core 11 after wrapping, saturation and removal of excess solvent of the method has been accomplished.

It is to be understood that within the context of this invention, the terminology "saturated to functional equilibrium" as it is used in connection with the saturation of the fabric and/or fabric roll with solvent means that after applying a measured amount of solvent or removing the excess solvent from the fabric and/or fabric roll, the fabric and/or fabric roll retains therein sufficient solvent or wetting agent in an amount to wet the fabric to the extent that it imparts efficient cleaning ability to the fabric to clean cylinders of apparatus, such as printing machinery, and the fabric has preferably retained therein after measured absorption or removal of the excess, if any removal is required, from about 0.02 cc to about 0.5 cc of solvent per $in^2$ of fabric.

In one embodiment, the so made cleaning system employing a reduced air content fabric of this invention can be employed on any printing apparatus simply by modifying the apparatus to provide it with at least one shaft which can be inserted through the open ends of the core. In a preferred embodiment, a single shaft is inserted through a hollow core. Additionally, the printing apparatus may be provided with a take-up roll which is employed to take up the used portion of the cleaning fabric after it has carried out its cleaning function. This is a distinct advantage of the cleaning system of this invention since it eliminates the need for complex apparatus, such as pumps, spray bars, manifold lines, valves and the like, especially as part of the automatic blanket cleaning systems used on printing machinery to introduce cleansing solvents or solutions to the cleaning fabric just prior to use.

In addition, the cleaning system of this invention provides numerous other advantages. For example, it is relatively simple in construction, employs readily available materials, and can be made in a relatively simple and forward manner without resort to highly complex and expensive procedures which necessitate the use of elaborate machinery. Additionally, the invention is an alternative to the invention discussed in U.S. Pat. No. 5,368,157 to Gasparrini et al. in that it provides for less solvent displacement during storage and thus less of a change in the fabric roll's center of gravity. Additionally, the use of a cleaning fabric with a reduced volume of air on the present and conventional systems not involving presoak techniques will have the advantage of having more fabric on a cleaning fabric supply roll of a given diameter. Numerous other advantages of this invention will be readily apparent to those skilled in the art.

It will remain understood by those skilled in the art that the present invention in its broader aspects is not limited to the particular embodiments shown and described herein, and that variations may be made which are within the scope of the accompanying claims without departing from the principles of the invention and without sacrificing its chief advantages.

We claim:

1. A device for cleaning a cylinder of a printing press comprising:

a reduced air content cleaning fabric having an air content by volume of 1 to 50 percent; and a solvent comprising a low volatility cleaning compound which does not readily evaporate at ambient temperature, and means for introducing said solvent being into said reduced air content cleaning fabric in an amount sufficient for cleaning said cylinder of a printing press.

2. The device for cleaning the cylinders of a printing press as defined in claim 1 further comprising a sealed sleeve disposed around and in contact with said fabric, said sealed sleeve containing substantially no air.

3. The device for cleaning the cylinders of a printing press as defined in claim 2 wherein said sealed sleeve is comprised of a heat-sealable plastic material selected from the group consisting of heat sealable polyethylene, heat-sealable polyolefins, polyvinyl chlorides, and heat-sealable polyamides.

4. The device for cleaning the cylinders of a printing press as defined in claim 2 wherein said sealed sleeve is shrinkable and is comprised of a heat-sealable and shrinkable plastic material selected from the group consisting of heat-sealable and shrinkable polyethylenes, heat-sealable and shrinkable polyolefins, heat-sealable and shrinkable polyvinyl chlorides, and heat-sealable and shrinkable polyamides.

5. The device for cleaning the cylinders of a printing press as defined in claim 2 further comprising a canister disposed between said fabric and said sleeve.

6. The device for cleaning the cylinders of a printing press as defined in claim 2 including a core which comprises an elongated cylinder having open end, said device further comprising end caps located in the open end of said core.

7. The device for cleaning the cylinders of a printing press as defined in claim 1 wherein the thickness of said fabric has been reduced by between about 10% to about 50%.

8. The device for cleaning the cylinders of a printing press as defined in claim 1 wherein said fabric is a cloth fabric.

9. The device for cleaning a cylinder of a printing press as defined in claim 1 wherein said fabric retains from about 0.02 to about 0.5 cc of said solvent per square inch of said fabric.

10. The device for cleaning the cylinders of a printing press as defined in claim 1 wherein said fabric comprises a mixture of wood pulp and polyester.

11. The device of claim 1 wherein said fabric has a length that is about 10 to 50 percent greater than the length of non-reduced air content fabric having an equal diameter about said core.

12. The device for cleaning a cylinder of a printing press as defined in claim 1 further comprising a means for positioning said fabric adjacent to said cylinder to be cleaned.

13. The device for cleaning a cylinder of a printing press as defined in claim 1 further comprising a mounting means for mounting said core and said fabric in a position to clean said cylinder while said fabric is in contact with and is fed past said cylinder.

14. A method for making a cleaning system comprising:

reducing air content of a strip of cleaning fabric by 1 to 50 percent to form a strip of reduced air cleaning fabric; and contacting said strip of reduced air content cleaning fabric with a low volatility, organic compound solvent which does not evaporate readily at ambient temperature and pressure and pre-soaking and saturating said reduced air content cleaning fabric with said solvent.

15. The method as defined in claim 14 further comprising the step of sealing said wrapped, saturated cleaning fabric roll in a substantially liquid impervious material so that said wrapped, saturated cleaning fabric roll can be transported and stored vertically and horizontally until use without substantially disturbing the distribution of said solvent in said fabric roll and detrimentally affecting the cleaning ability of said fabric.

16. The method as defined in claim 15 wherein said step of sealing comprises disposing a sealable sleeve around the wrapped, saturated fabric roll and sealing said sealable sleeve around said wrapped, saturated fabric roll.

17. The method as defined in claim 16 wherein said step of sealing comprises subjecting said sealable sleeve to a vacuum to remove substantially all of the air from said sealable sleeve before sealing said sleeve.

18. The method as defined in claim 14 including providing an elongated core wherein said strip of cleaning fabric is wrapped about said elongated core prior to contacting said strip of cleaning fabric with said solvent.

19. The method as defined in claim 14 wherein the step of contacting said strip comprises saturating said fabric beyond equilibrium with excess solvent and removing said solvent so that said fabric is in functional equilibrium.

20. The method as defined in claim 19 wherein said solvent is removed until said fabric retains from about 0.02 to about 0.5 cc of solvent per square inch of said fabric.

21. The method as defined by claim 14 wherein said step of contacting said strip comprises bringing a measured amount of said solvent in contact with said strip of cloth and allowing said measured amount of solvent to be absorbed.

22. The method as defined in claim 21 wherein said fabric absorbs from about 0.02 to about 0.5 cc of said solvent per square inch of said fabric.

23. The method as defined in claim 14 further comprising the steps of:

(a) unwinding at least a portion of said cleaning fabric from said fabric roll;

(b) placing said at least a portion of said cleaning fabric in contact with a cylinder to be cleaned; and (c) taking-up said at least a portion of said cleaning fabric on a take-up shaft.

24. The method as defined in claim 14 wherein the step of reducing air content of said strip of cleaning fabric comprises calendaring said cleaning fabric.

25. The method as defined in claim 14 wherein the step of reducing air content of said strip of cleaning fabric is accomplished by reducing the thickness of said cleaning fabric by between about 10% to about 50%.

26. The method as defined in claim 14 wherein said step of reducing air content of said strip of cleaning fabric further comprises the step of increasing the length of said cleaning fabric by at least about 25% without substantially effecting the diameter of said fabric roll after the cleaning fabric has been wound about a core.

* * * * *

UNITED STATES PATENT AND TRADEMARK OFFICE

CERTIFICATE OF CORRECTION

PATENT NO. : 5,974,976
DATED : August 27, 1997
INVENTOR(S) : C. Robert Gasparrini et al.

It is certified that error appears in the above-identified patent and that said Letters Patent is hereby corrected as shown below:

Column 11,
Line 61, "of" has been replaced with -- reduced by --.

Signed and Sealed this

Twenty-second Day of October, 2002

*Attest:*

*Attesting Officer*

JAMES E. ROGAN
*Director of the United States Patent and Trademark Office*